US009653031B2

(12) United States Patent
Wu

(10) Patent No.: US 9,653,031 B2
(45) Date of Patent: May 16, 2017

(54) MULTI-TYPE COMMON VOLTAGE DRIVING METHOD, COMMON VOLTAGE CONTROL APPARATUS, AND DISPLAY DRIVING CIRCUIT

(75) Inventor: Tse-Hung Wu, New Taipei (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 254 days.

(21) Appl. No.: 13/276,282

(22) Filed: Oct. 18, 2011

(65) Prior Publication Data

US 2013/0016085 A1 Jan. 17, 2013

(30) Foreign Application Priority Data

Jul. 11, 2011 (TW) ..... 100124432 A

(51) Int. Cl.
*G09G 3/36* (2006.01)

(52) U.S. Cl.
CPC ..... *G09G 3/3648* (2013.01); *G09G 3/3614* (2013.01); *G09G 3/3655* (2013.01); *G09G 2320/02* (2013.01)

(58) Field of Classification Search
CPC .. G09G 3/3655; G09G 3/3696; G09G 3/3614; G09G 3/3611
USPC ..... 345/89–100, 211–213
See application file for complete search history.

(56) References Cited

U.S. PATENT DOCUMENTS

2002/0041281 A1* 4/2002 Yanagi et al. ..... 345/212
2002/0154086 A1 10/2002 Furuhashi et al.
2005/0001798 A1* 1/2005 Nohtomi et al. ..... 345/87
2005/0219185 A1* 10/2005 Hung ..... G09G 3/3655 345/90
2006/0007094 A1* 1/2006 Kang et al. ..... 345/98
2008/0111767 A1* 5/2008 Liu ..... G09G 3/3611 345/58
2009/0051837 A1 2/2009 Xiao
2009/0135171 A1* 5/2009 Chen et al. ..... 345/211
2009/0237340 A1* 9/2009 Park et al. ..... 345/90
(Continued)

FOREIGN PATENT DOCUMENTS

CN 1339934 3/2002
CN 1348159 5/2002
(Continued)

OTHER PUBLICATIONS

"Office Action of China Counterpart Application" , issued on Oct. 10, 2014, p. 1-p. 8.
(Continued)

*Primary Examiner* — Jennifer Mehmood
*Assistant Examiner* — James Nokham
(74) *Attorney, Agent, or Firm* — Jianq Chyun IP Office

(57) ABSTRACT

A multiple common voltage driving method adapted for a display is provided. The driving method includes following steps: taking a common-voltage switching time unit as a repeating time unit to provide a common voltage to define a reference voltage of the display. The common-voltage switching time unit has a plurality of different types of common-voltage pattern periods. A time length of each of the common-voltage pattern periods includes at least one frame. During the different types of the common-voltage pattern periods, the provided common voltage has different AC voltage swings or different DC voltage levels.

23 Claims, 6 Drawing Sheets

(56) References Cited

U.S. PATENT DOCUMENTS

| | | | | |
|---|---|---|---|---|
| 2011/0090196 | A1 | 4/2011 | Li et al. | |
| 2011/0096064 | A1* | 4/2011 | Sun | 345/212 |

FOREIGN PATENT DOCUMENTS

| | | |
|---|---|---|
| CN | 1740858 | 3/2006 |
| CN | 101587692 | 11/2009 |
| CN | 101996592 | 3/2011 |
| TW | 594138 | 6/2004 |
| TW | I235348 | 7/2005 |
| TW | 200534205 | 10/2005 |
| TW | 200832322 | 8/2008 |
| TW | 201025250 | 7/2010 |
| TW | 201028982 | 8/2010 |

OTHER PUBLICATIONS

"Office Action of Taiwan Counterpart Application", issued on Aug. 26, 2015, p. 1-p. 8.
"Office Action of Child U.S. Appl. No. 14/454,724", issued on Oct. 22, 2015, p. 1-p. 19.

* cited by examiner

MULTI-TYPE COMMON VOLTAGE DRIVING METHOD, COMMON VOLTAGE CONTROL APPARATUS, AND DISPLAY DRIVING CIRCUIT

CROSS-REFERENCE TO RELATED APPLICATION

This application claims the priority benefit of Taiwan application serial no. 100124432, filed on Jul. 11, 2011. The entirety of the above-mentioned patent application is hereby incorporated by reference herein and made a part of this specification.

BACKGROUND OF THE INVENTION

Field of the Invention

The invention relates to a driving method. Particularly, the invention relates to a common voltage driving method of a display.

Description of Related Art

Rapid progress of multimedia society is mainly benefited from progress of semiconductor devices or display devices. Regarding the display devices, a liquid crystal display (LCD) has gradually become popular in the market due to its characteristics of high image quality, good space utilization efficiency, low power consumption and no irradiation, etc. It should be noted that in driving architectures of the LCD, an alternating current (AC) mode common voltage driving architecture (for example, a line inversion driving method) is generally used to drive middle and small-size LCD panels, while a direct current (DC) mode common voltage driving architecture (for example, a dot inversion display technique) is generally used to drive large-size LCD panels.

However, if the AC mode common voltage driving architecture is used to drive the existing middle and small-size LCD panel, although a whole power consumption of the LCD is decreased, image quality presented by the LCD is not fine. Moreover, if the DC mode common voltage driving architecture is used to drive the existing large-size LCD panel, although the image quality of the LCD is improved, the whole power consumption of the LCD is increased. On the other hand, the general AC or DC mode common voltage driving architecture is not applicable for improving the display quality.

SUMMARY OF THE INVENTION

The invention is directed to a multi-type common voltage driving method, which is capable of eliminating display abnormity of a display by dynamically adjusting a common voltage, so as to improve display quality.

The invention is directed to a display driving circuit, which is capable of eliminating display abnormity of a display by dynamically adjusting a common voltage, so as to improve display quality.

The invention is directed to a common voltage control apparatus, which is capable of eliminating display abnormity of a display by dynamically adjusting a common voltage, so as to improve display quality.

The invention provides a multi-type common voltage driving method, which is adapted to drive a display. The multi-type driving method includes following steps. A common voltage switching time unit is taken as a repeating time unit to provide a common voltage to define a reference voltage of the display. The common voltage switching time unit has a plurality of different types of common voltage pattern periods. A time length of each of the common voltage pattern periods includes at least one frame. During the different types of the common voltage pattern periods, the provided common voltage has different alternating current (AC) voltage swings or different direct current (DC) voltage levels.

In an embodiment, in the common voltage switching time unit, the different types of the common voltage pattern periods include a plurality of AC-type common voltage pattern periods, during which the provided common voltage has different AC voltage swings.

In another embodiment, in the common voltage switching time unit, the different types of the common voltage pattern periods further include a plurality of DC-type common voltage pattern periods sequentially arranged behind the AC-type common voltage pattern periods, during which the provided common voltage has different DC voltage levels.

In an embodiment, in the common voltage switching time unit, the different types of the common voltage pattern periods include a plurality of DC-type common voltage pattern periods, during which the provided common voltage has different DC voltage levels.

In an embodiment, in the common voltage switching time unit, the different types of the common voltage pattern periods include a plurality of AC-type common voltage pattern periods sequentially arranged behind the DC-type common voltage pattern periods, during which the provided common voltage has different AC voltage swings.

In an embodiment, a number of the common voltage pattern periods, the respective time lengths thereof, and the respective AC voltage swings or the DC voltage levels of the common voltage therein are determined according to different types of polarity distribution patterns on the display.

In an embodiment, the display takes the common voltage switching time unit as the repeating time unit to change its polarity distribution patterns, and the common voltage pattern periods respectively correspond to the polarity distribution patterns.

In an embodiment, the number of the common voltage pattern periods, the respective time lengths thereof, and the respective AC voltage swings or the DC voltage levels of the common voltage therein are determined according to different image contents of the display.

The invention provides a display driving circuit, which is adapted to drive a display. The display driving circuit includes a timing circuit and a common voltage generating unit. The timing circuit indicates a common voltage switching time unit. The common voltage generating unit takes the common voltage switching time unit as a repeating time unit to provide a common voltage to define a reference voltage of the display. The common voltage switching time unit has a plurality of different types of common voltage pattern periods. A time length of each of the common voltage pattern periods includes at least one frame. During the different types of the common voltage pattern periods, the provided common voltage has different alternating current (AC) voltage swings or different direct current (DC) voltage levels.

In an embodiment, the display driving circuit further includes a common voltage control unit. The common voltage control unit controls the common voltage generating unit to provide the common voltage having different AC voltage swings or different DC voltage levels according to different types of polarity distribution patterns or different image contents of the display.

In an embodiment, in the common voltage switching time unit, the different types of the common voltage pattern periods include a plurality of AC-type common voltage pattern periods, during which the provided common voltage has different AC voltage swings.

In an embodiment, in the common voltage switching time unit, the different types of the common voltage pattern periods further include a plurality of DC-type common voltage pattern periods sequentially arranged behind the AC-type common voltage pattern periods, during which the provided common voltage has different DC voltage levels.

In an embodiment, in the common voltage switching time unit, the different types of the common voltage pattern periods include a plurality of DC-type common voltage pattern periods, during which the provided common voltage has different DC voltage levels.

In an embodiment, in the common voltage switching time unit, the different types of the common voltage pattern periods include a plurality of AC-type common voltage pattern periods sequentially arranged behind the DC-type common voltage pattern periods, during which the provided common voltage has different AC voltage swings.

In an embodiment, a number of the common voltage pattern periods, the respective time lengths thereof, and the respective AC voltage swings or the DC voltage levels of the common voltage therein are determined according to different types of polarity distribution patterns on the display.

In an embodiment, the display takes the common voltage switching time unit as the repeating time unit to change its polarity distribution patterns, and the common voltage pattern periods respectively correspond to the polarity distribution patterns.

In an embodiment, a number of the common voltage pattern periods, the respective time lengths thereof, and the respective AC voltage swings or the DC voltage levels of the common voltage therein are determined according to different image contents of the display.

The invention provides a common voltage control apparatus, which is adapted to a display driving circuit, wherein the display driving circuit includes a common voltage generating unit. The common voltage control apparatus controls the common voltage generating unit to take a common voltage switching time unit as a repeating time unit to provide a common voltage according to different types of polarity distribution patterns or different image contents of the display. The common voltage switching time unit has a plurality of different types of common voltage pattern periods. A time length of each of the common voltage pattern periods includes at least one frame. During the different types of the common voltage pattern periods, the provided common voltage has different alternating current (AC) voltage swings or different direct current (DC) voltage levels.

In an embodiment, the common voltage control apparatus includes an image determining unit and a logic control unit. The image determining unit determines a type of the polarity distribution patterns or the image contents according to an image displayed on the display to provide a determination result. The logic control unit controls the common voltage generating unit to provide the common voltage having different AC voltage swings or different DC voltage levels according to the determination result.

In an embodiment, the common voltage control apparatus further includes a look-up table. The look-up table stores corresponding relationship between the types of the polarity distribution patterns or the image contents and the AC voltage swings or DC voltage levels of the common voltage. The logic control unit controls the common voltage generating unit to provide the common voltage having different AC voltage swings or different DC voltage levels according to the look-up table.

The invention provides a multi-type common voltage driving method, which is adapted to drive a display. The multi-type driving method includes following steps. A common voltage of at least one of an AC pattern or a DC pattern is used to drive the display. A common voltage switching time unit is taken as a repeating time unit to determine a polarity distribution pattern or an image content of a current image displayed on the display. At least one of an AC voltage swing or a DC voltage level of the common voltage is adjusted according to the polarity distribution pattern or the image content of the current image. The common voltage is provided to define a reference voltage of the display.

In an embodiment, the common voltage switching time unit has a plurality of different types of common voltage pattern periods. A time length of each of the common voltage pattern periods includes at least one frame.

In an embodiment, during the different types of the common voltage pattern periods, the provided common voltage has different AC voltage swings or different DC voltage levels.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Generally, a main driving method of a display panel is by using a common voltage to define a reference voltage of a liquid crystal display (LCD) panel, wherein the types of the common voltage can include an alternating current (AC)-type and a direct current (DC)-type. In an exemplary embodiment, the common voltage provided during a driving period has different AC voltage swings or different DC voltage levels, by which display abnormity can be eliminated by dynamically adjusting the common voltage, and thereby display quality can be improved.

Figure 1A:
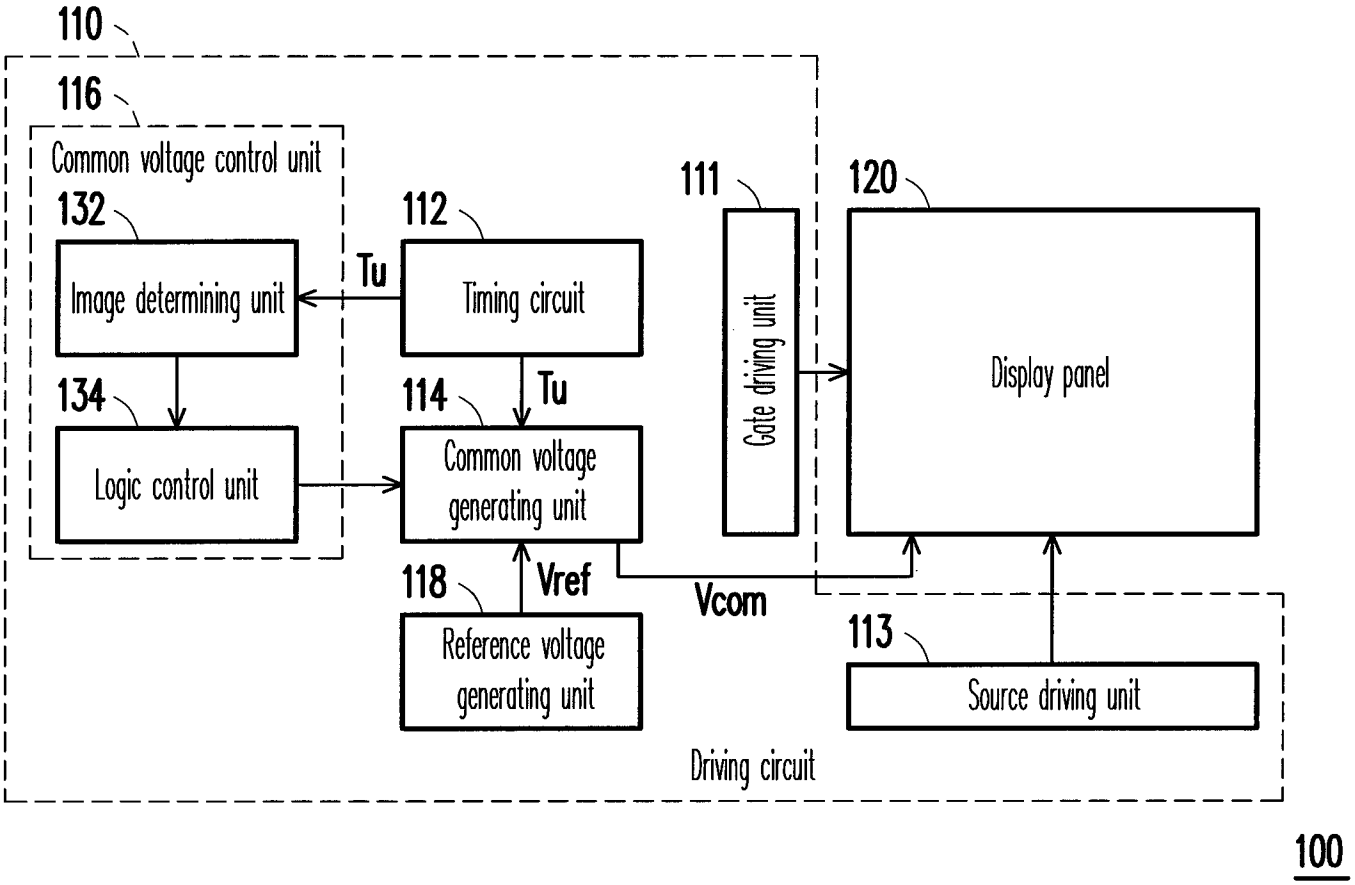
FIG. 1A and FIG. 1B are block schematic diagrams of displays according to different embodiments of the invention.

FIG. 1A is a block schematic diagram of a display according to an embodiment. Referring to FIG. 1A, the display 100 of the present embodiment includes a driving circuit 110 and a display panel 120. The driving circuit 110 receives a video image signal (not shown), and drives the display panel 120 to display a corresponding image content. In the present embodiment, besides a gate driving unit 111 and a source driving unit 113, the driving 110 further includes a timing circuit 112, a common voltage generating unit 114, a common voltage control unit 116 and a reference voltage generating unit 118.

The display panel 120 includes a pixel array, and the gate driving unit 111 and the source driving unit 113 are used to implement display data scanning and data writing functions. A common voltage Vcom is generated by the common voltage generating unit 114, the common voltage control unit 116 and the reference voltage generating unit 118 in collaboration. The common voltage control unit 116 controls the common voltage generating unit 114 to generate different common voltages Vcom. The reference voltage generating unit 118 provides one a plurality of reference voltages required by the common voltage generating unit 114 during generation of the common voltage Vcom.

Under the control of the common voltage control unit 116, the common voltage generating unit 114 takes a common voltage switching time unit Tu as a repeating time unit to provide the common voltage Vcom to the display panel 120 to define a reference voltage of the display panel 120. The common voltage switching time unit Tu is composed of a plurality of different types of common voltage pattern periods, and during the different types of the common voltage pattern periods, the provided common voltage Vcom has different alternating current (AC) voltage swings or different direct current (DC) voltage levels. Moreover, the common voltage switching time unit Tu can be generated by the timing circuit 112 and provided to the common voltage generating unit 114 and the common voltage control unit 116.

A time length of the common voltage switching time unit Tu and contents of the common voltage pattern periods therein can be determined according to different design requirements. For example, the common voltage control unit 116 correspondingly controls the common voltage generating unit 114 to provide the common voltage Vcom having different AC voltage swings or different DC voltage levels to the display panel 120 according to different types of polarity distribution patterns or different image contents of the display panel 120. In other words, a type (the time length and content) of the common voltage switching time unit can be dynamically changed according to a system operation status to optimise the system operation.

FIG. 1A also illustrates a detailed structure of the common voltage control unit 116. In the present embodiment, the common voltage control unit 116 includes an image determining unit 132 and a logic control unit 134. The image determining unit 132 determines a type of the polarity distribution patterns or the image contents according to an image displayed on the display to provide a determination result. The logic control unit 134 controls the common voltage generating unit 114 to provide the common voltage Vcom having different AC voltage swings to the display panel 120 according to the determination result. In this way, the number of the common voltage pattern periods, the respective time lengths thereof, and the respective AC voltage swings of the common voltage Vcom therein can be determined according to different types of the polarity distribution patterns or the image contents on the display.

Regarding different types of the polarity distribution patterns of the display, the image determining unit 132 receives an inversed reference signal (not shown) to obtain a polarity inversion mode of the display in each frame period. Regarding different polarity inversion modes of the display, the common voltage generating unit 114 can set the AC voltage swings of the common voltage Vcom through the logic control unit 134. Here, the inversed reference signal can be generated by a circuit of a previous stage outside the driving circuit 110 or provided by the source driving unit 113.

On the other hand, regarding different image contents on the display, the image determining unit 132 receives a video image signal (not shown) to obtain information of the image contents displayed by the display in each frame period. The information may include image content characteristics such as image resolution, image brightness, image spectrum distribution, a number of colors, an image refreshing rate or a display mode (i.e. 2D image or 3D image), etc. Regarding different image contents, the common voltage generating unit 114 can set the AC voltage swings of the common voltage Vcom through the logic control unit 134. Here, the video image signal can be generated by a circuit of a previous stage outside the driving circuit 110 or provided by the source driving unit 113.

As described above, the common voltage provided during the driving period may have different AC voltage swings or different DC voltage levels at different time points according to an application requirement (for example, the image content or the polarity distribution pattern). As a result, display abnormity can be eliminated by dynamically adjusting the common voltage, so as to improve the display quality.

It should be noted that in the embodiment of FIG. 1A, the common voltage control unit 116 controls the common voltage generating unit 114 to produce the common voltage Vcom. In other embodiments, the common voltage control unit 116 can only control the reference voltage generating unit 118 or simultaneously control both of the common voltage generating unit 114 and the reference voltage generating unit 118 to produce the common voltage Vcom.

Moreover, it should be noted that in the present embodiment, the common voltage switching time unit Tu is produced by the timing circuit 112 and is provided to the common voltage generating unit 114 and the common voltage control unit 116. However, in other embodiment, the common voltage switching time unit Tu can be produced by different circuits according to different requirements, and can be provided to at least one of the common voltage generating unit 114, the common voltage control unit 116 and the reference voltage generating unit 118. For example, in an embodiment, the timing circuit 112 only provides the common voltage switching time unit Tu to the common voltage generating unit 114. In another embodiment, the common voltage switching time unit Tu is produced by the timing circuit 112 and is provided to the common voltage control unit 116 (for example, the image determining unit 132), and the common voltage control unit 116 (for example, the logic control unit 134) indicate the common voltage switching time unit Tu for the common voltage generating unit 114.

Moreover, it should be noticed that the various circuits in the driving circuit 110 can be implemented by a single integrated circuit (IC) chip, or can be implemented by a plurality of IC chips. For example, the common voltage generating unit 114, the common voltage control unit 116 and the reference voltage generating unit 118 can be implemented by an IC chip different to an IC chip used for implementing the gate driving unit 111, the timing circuit 112 and the source driving unit 112.

Figure 1B:
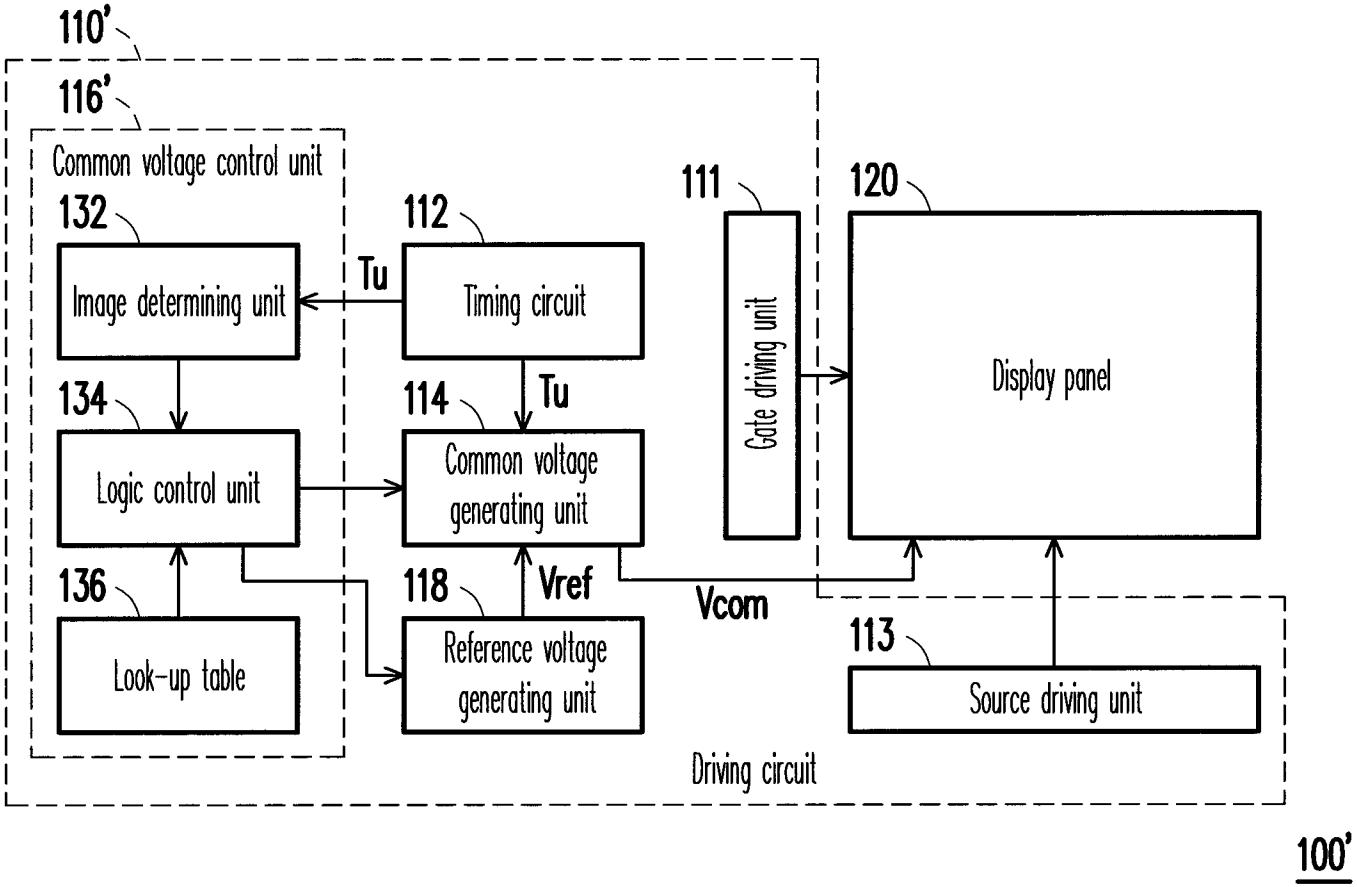

FIG. 1B is a block schematic diagram of a display according to another embodiment. Referring to FIG. 1A and FIG. 1B, the display 100' of the present embodiment is similar to the display 100 of FIG. 1A, though a main difference there between is that a common voltage control unit 116' of the present embodiment further includes a look-up table 136. The look-up table 136 stores corresponding relationship between the types of the polarity distribution patterns or the image contents and the AC voltage swings of the common voltage Vcom, and after receiving the determination result of the image determining unit 132, the logic control unit 134 controls the common voltage generating unit 114 to provide the common voltage Vcom having different AC voltage swings according to the look-up table 136. Other operation details can be deduced according to the related descriptions of FIG. 1A, which are not repeated herein.

Figure 2:
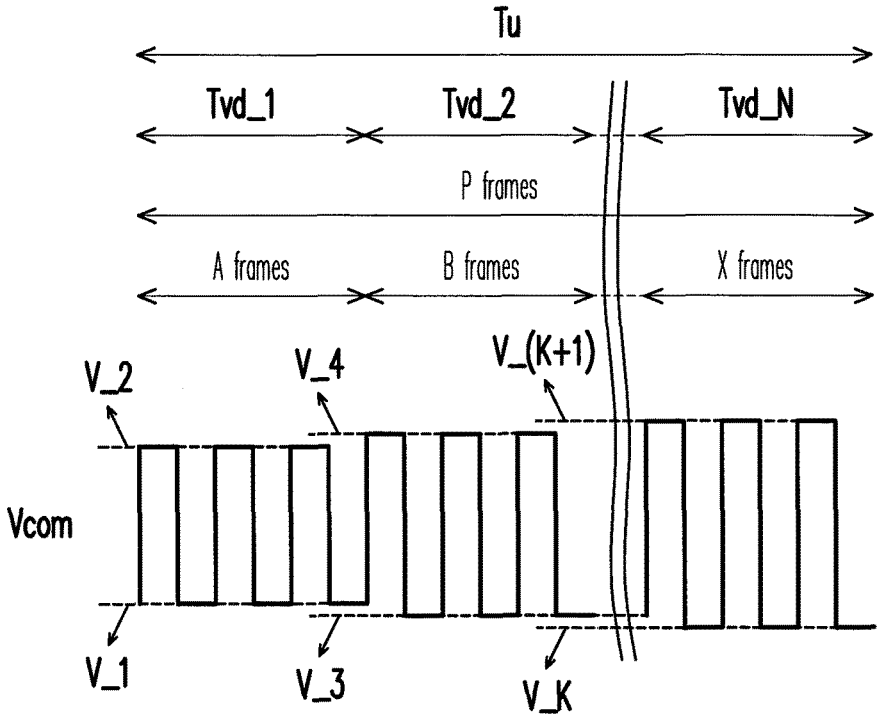
FIG. 2 is a waveform diagram of an AC-type common voltage in a common voltage switching time unit according to an embodiment.

FIG. 2 is a waveform diagram of an AC-type common voltage in the common voltage switching time unit according to an embodiment. Referring to FIG. 1A and FIG. 2, in the present embodiment, the common voltage generating unit 114 takes the common voltage switching time unit Tu as a repeating time unit to provide the common voltage Vcom having different AC voltage swings to define a reference voltage of the display panel 120.

The common voltage switching time unit Tu of the present embodiment includes a plurality of AC-type common voltage pattern periods Tvd_1, Tvd_2, . . . , Tvd_N, during which the provided common voltage Vcom has different AC voltage swings. Moreover, a time length of each of the common voltage pattern periods includes at least one frame.

For example, a time length of the common voltage pattern period Tvd_1 includes A frames, during which the provided common voltage Vcom is an AC square wave oscillated between voltage levels V_1 and V_2. A time length of the common voltage pattern period Tvd_2 includes B frames, during which the provided common voltage Vcom is an AC square wave oscillated between voltage levels V_3 and V_4. A time length of the common voltage pattern period Tvd_N includes X frames, during which the provided common voltage Vcom is an AC square wave oscillated between voltage levels V_K and V_(K+1). Here, the AC voltage swings, for example, refer to a difference between the voltage levels V_1 and V_2, a difference between the voltage levels V_3 and V_4, and a difference between the voltage levels V_K and V_(K+1).

As described above, in the present embodiment, two or more different AC voltage swings of the common voltage Vcom are switched within the common voltage switching time unit Tu, which is taken as a repeating time unit to drive the display panel 120 to define the reference voltage thereof.

Figure 3:
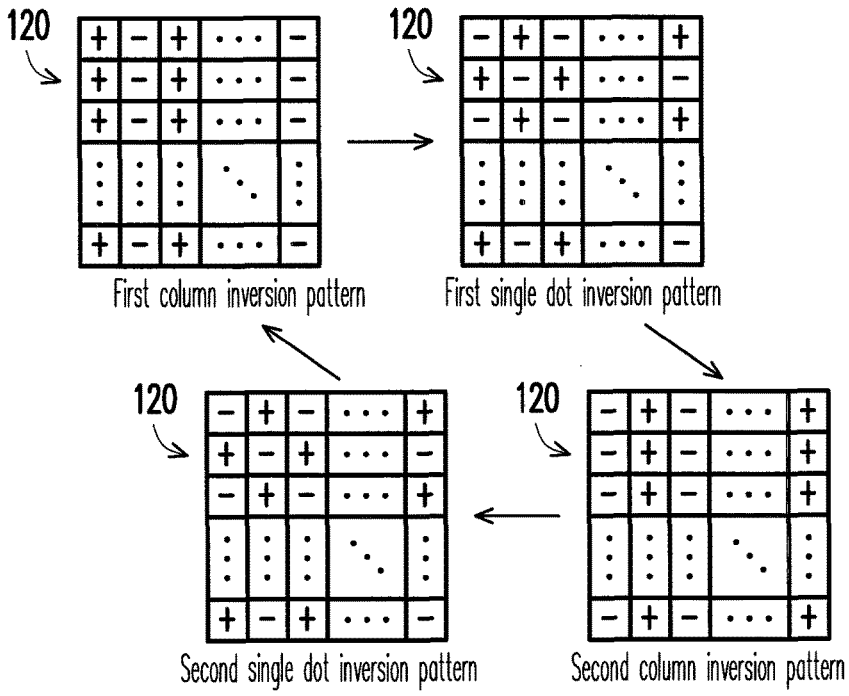
FIG. 3 is a schematic diagram of polarity distribution patterns on a display panel according to an embodiment.

FIG. 3 is a schematic diagram of polarity distribution patterns on the display panel according to an embodiment. Referring to FIG. 1A and FIG. 3, in the present embodiment, the display panel 120 is switched in cycle among two column inversion patterns and two single dot inversion patterns shown in FIG. 3 during the common voltage pattern periods Tvd_1, Tvd_2, . . . , Tvd_N. For example, in the common voltage pattern period Tvd_1, the polarity distribution pattern of the display panel 120 is, for example, a first column inversion pattern. In the common voltage pattern period Tvd_2, the polarity distribution pattern of the display panel 120 is, for example, a first single dot inversion pattern. In the common voltage pattern period Tvd_3, the polarity distribution pattern of the display panel 120 is, for example, a second column inversion pattern. In the common voltage pattern period Tvd_4, the polarity distribution pattern of the display panel 120 is, for example, a second single dot inversion pattern. In the common voltage pattern periods Tvd_5, Tvd_6, . . . , Tvd_N, the polarity distribution patterns of the display panel 120 are switched in cycle according to the above description, though the polarity distribution patterns of the invention are not limited to be switched between the column inversion pattern and the single dot inversion pattern. In other embodiments, at least one of the polarity distribution patterns of the display panel 120 is selected from the following polarity distribution patterns of row inversion, column inversion, single dot inversion, multiple dot inversion, M+N dot inversion and frame inversion.

Corresponding to the polarity distribution patterns of FIG. 3, the display 100 takes the common voltage switching time unit Tu as the repeating time unit to change its polarity distribution patterns, where a first common voltage switching time unit Tu is composed of the common voltage pattern periods Tvd_1, Tvd_2, . . . , Tvd_4, which respectively correspond to the aforementioned four types of polarity distribution patterns, and a second common voltage switching time unit Tu is composed of the common voltage pattern periods Tvd_5, Tvd_6, . . . , Tvd_8, which respectively correspond to the aforementioned four types of polarity distribution patterns, and the other are deduced by analogy.

In the aforementioned embodiment, the common voltage generating unit 114 provides the common voltage Vcom having different AC voltage swings within the common voltage switching time unit Tu. In another embodiment, the common voltage generating unit 114 can also provide the common voltage Vcom having different DC voltage levels to define the reference voltage of the display panel 120.

Figure 4:
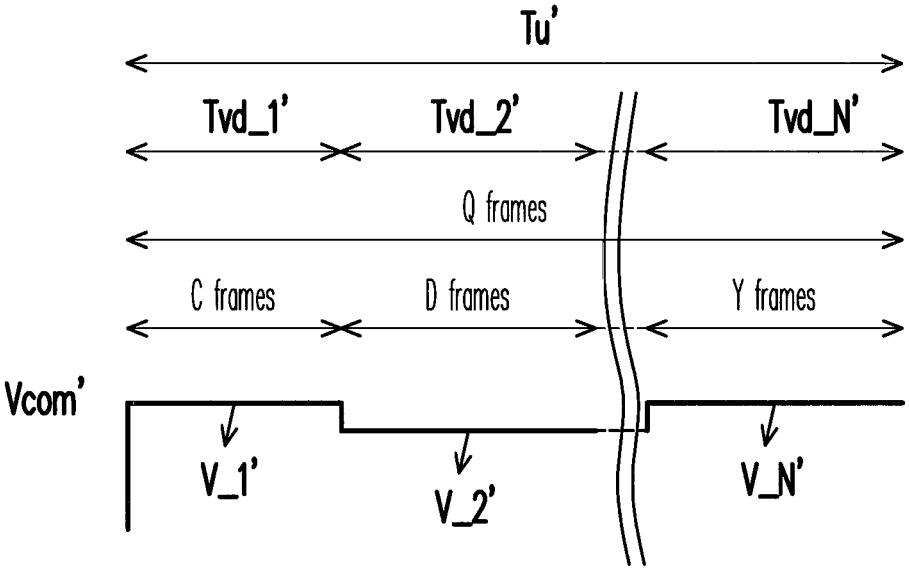
FIG. 4 is a waveform diagram of a DC-type common voltage in a common voltage switching time unit according to an embodiment.

FIG. 4 is a waveform diagram of a DC-type common voltage in the common voltage switching time unit according to an embodiment. In the present embodiment, during different types of common voltage pattern periods Tvd_1', Tvd_2', . . . , Tvd_N', a provided common voltage Vcom' has different DC voltage levels.

In detail, the common voltage switching time unit Tu' of the present embodiment includes a plurality of DC-type common voltage pattern periods Tvd_1', Tvd_2', . . . , Tvd_N', during which the provided common voltage Vcom' has different DC voltage levels. Moreover, a time length of each of the common voltage pattern periods includes at least one frame.

For example, a time length of the common voltage pattern period Tvd_1' includes C frames, during which the provided common voltage Vcom' is a DC voltage with a level of V_1'. A time length of the common voltage pattern period Tvd_2' includes D frames, during which the provided common voltage Vcom' is a DC voltage with a level of V_2'. A time length of the common voltage pattern period Tvd_N' includes Y frames, during which the provided common voltage Vcom' is a DC voltage with a level of V_N'.

Therefore, in the present embodiment, three or more different DC voltage levels of the common voltage Vcom are switched within the common voltage switching time unit Tu, which is taken as a repeating time unit to drive the display panel 120 to define the reference voltage thereof.

It should be noted that in the present embodiment, the number of the common voltage pattern periods, the respective time lengths thereof, and the respective DC voltage levels of the common voltage Vcom thereof are determined according to different types of the polarity distribution patterns or the image contents on the display, and determinations thereof are similar to that of the above embodiment where the common voltage is the AC voltage (i.e. the embodiment of FIG. 2), which are not repeated herein.

Figure 5:
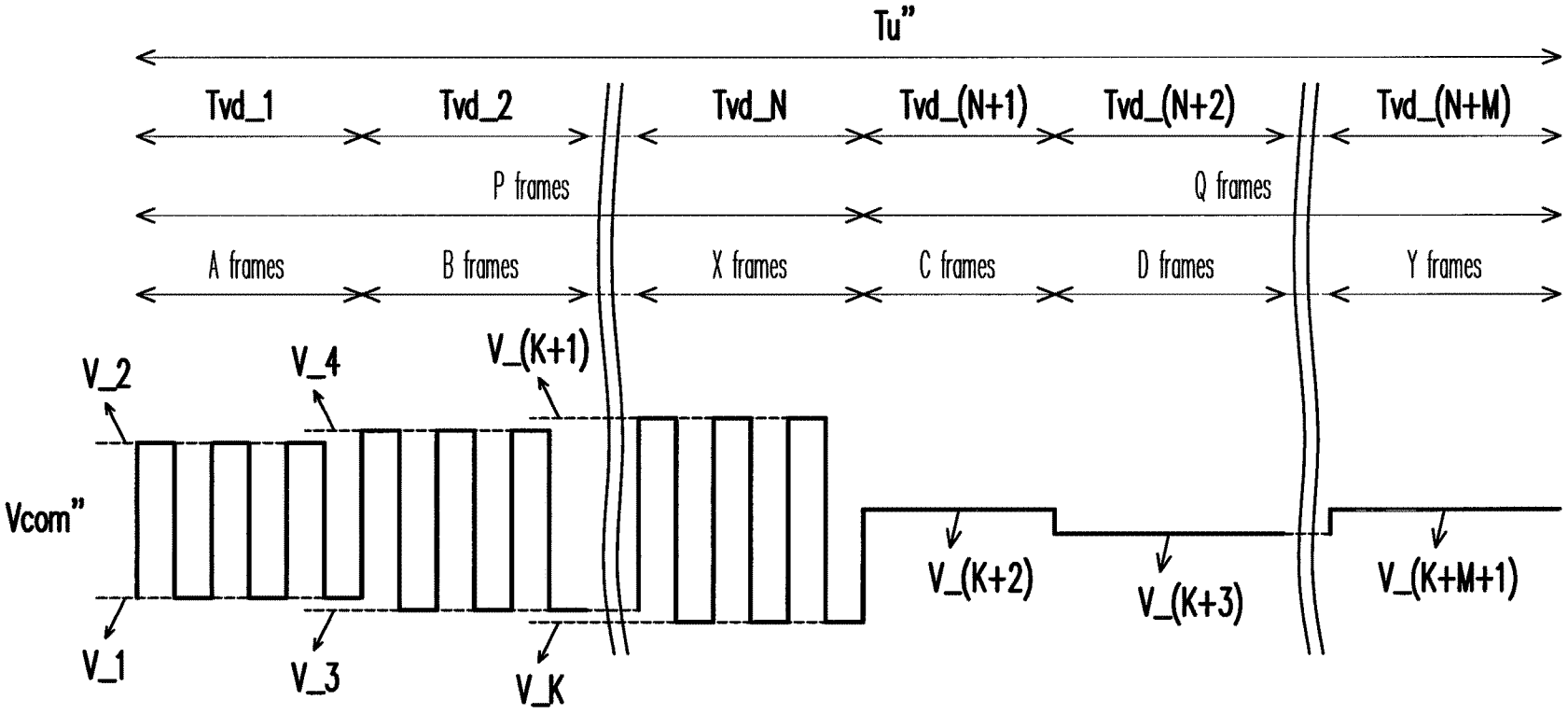
FIG. 5 is a waveform diagram of an AC-DC hybrid-type common voltage in a common voltage switching time unit according to an embodiment.

FIG. 5 is a waveform diagram of an AC-DC hybrid-type common voltage in the common voltage switching time unit according to an embodiment. In the present embodiment, during different types of common voltage pattern periods Tvd_1, Tvd_2, . . . , Tvd_(N+M), the provided common voltage Vcom' has different AC voltage swings or different DC voltage levels.

In detail, a common voltage switching time unit Tu" of the present embodiment includes a plurality of AC-type common voltage pattern periods Tvd_1, Tvd_2, . . . , Tvd_N, and a plurality of DC-type common voltage pattern periods Tvd_(N+1), Tvd_(N+2), . . . , Tvd_(N+M). During the common voltage pattern periods Tvd_1, Tvd_2, . . . , Tvd_N, a provided common voltage Vcom" has different AC voltage swings. During the common voltage pattern periods Tvd_(N+1), Tvd_(N+2), . . . , Tvd_(N+M), the provided common voltage Vcom" has different DC voltage levels.

In the present embodiment, the DC-type common voltage pattern periods Tvd_(N+1), Tvd_(N+2), . . . , Tvd_(N+M) are sequentially arranged behind the AC-type common voltage pattern periods Tvd_1, Tvd_2, . . . , Tvd_N, though the invention is not limited thereto. In another embodiment, the AC-type common voltage pattern periods can also be sequentially arranged behind the DC-type common voltage pattern periods.

Therefore, in the present embodiment, at least two different AC voltage swings and at least three different DC voltage levels of the common voltage Vcom" are switched within the common voltage switching time unit Tu", which is taken as a repeating time unit to drive the display panel 120 to define the reference voltage thereof.

It should be noted that in the present embodiment, the number of the common voltage pattern periods, the respective time lengths thereof, and the respective AC voltage swings and DC voltage levels of the common voltage Vcom thereof can be determined according to different types of the polarity distribution patterns or the image contents on the display, and determinations thereof are similar to that of the above embodiment where the common voltage is an AC voltage (i.e. the embodiment of FIG. 2), or the above embodiment where the common voltage is a DC voltage (i.e. the embodiment of FIG. 4), which are not repeated herein.

Figure 6:
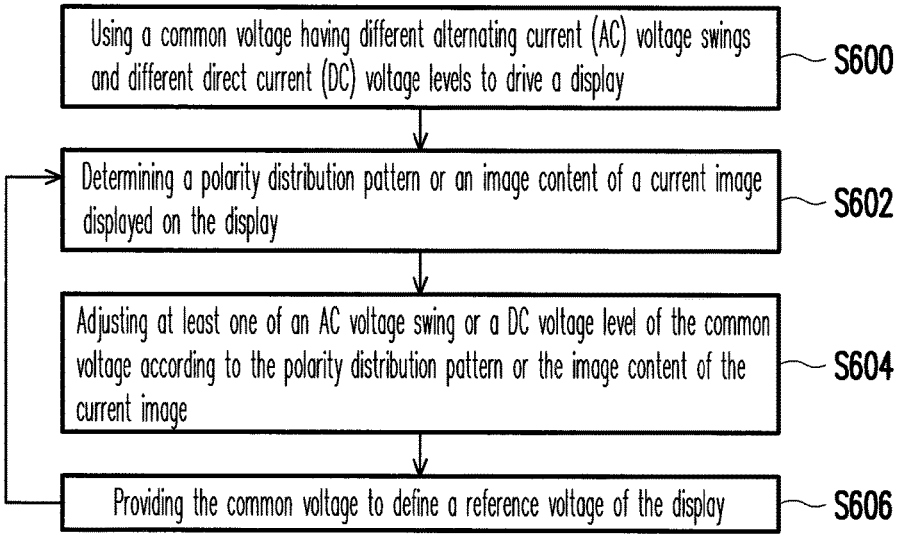
FIG. 6 is a flowchart illustrating a multi-type common voltage driving method according to an embodiment.

FIG. 6 is a flowchart illustrating a multi-type common voltage driving method according to an embodiment. Referring to FIG. 1A and FIG. 6, the multi-type common voltage driving method of the present embodiment is, for example, adapted to drive the display of FIG. 1A or FIG. 1B. Taking the display 100 of FIG. 1A and the AC-DC hybrid-type common voltage of FIG. 5 as an example, the multi-type common voltage driving method includes following steps. First, in step S600, the common voltage Vcom" is used to drive the display 100, where the common voltage Vcom" of the present embodiment has different AC voltage swings and different DC voltage levels within the common voltage switching time unit Tu". In other embodiments, the common voltage may only have different AC voltage swings or different DC voltage levels within the common voltage switching time unit Tu". Then, in step S602, a polarity distribution pattern or an image content of a current frame displayed on the display 100 is determined. Then, in step S604, at least one of the AC voltage swing and the DC voltage level of the common voltage Vcom" is adjusted according to the above determination result. Then, in step S606, the common voltage Vcom" is provided to the display panel 120 to define the reference voltage of the display 100.

Figure 7:
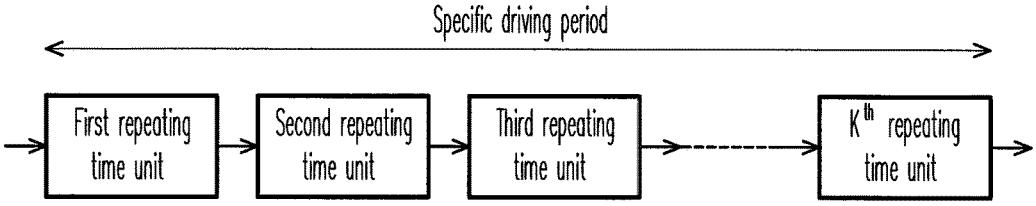
FIG. 7 is a timing schematic diagram of a specific driving period of a display.

FIG. 7 is a timing schematic diagram of a specific driving period of a display. In the specific driving period, the common voltage generating unit 114 takes the common voltage switching time unit as a repeating time unit to provide the common voltage Vcom to define the reference voltage of the display panel 120. Referring to FIGS. 1A-1B, FIG. 6 and FIG. 7, in the present embodiment, after the step S606 is completed, the multi-type common voltage driving method is returned to the step S602 to continually determine the polarity distribution pattern or the image content of the current frame displayed on the display 100. Therefore, during the specific driving period, the common voltage control unit 116 controls the common voltage generating unit 114 according to different types of the polarity distribution patterns or different image contents on the display 100, and the common voltage generating unit 114 takes the common voltage switching time unit as the repeating time unit to provide the common voltage Vcom" to the display panel 120, so as to define the reference voltage of the display 100, as that shown in FIG. 7.

In the present embodiment, the repeating time unit is, for example, the common voltage switching time unit Tu of FIG. 2, the common voltage switching time unit Tu' of FIG. 4, or the common voltage switching time unit Tu" of FIG. 5. Moreover, since those skilled in the art can learn enough teachings, suggestions, and implementation details for the multi-type common voltage driving method of the present embodiment from the descriptions of the embodiments of FIG. 1A to FIG. 5, detailed description thereof is not repeated.

In summary, in the exemplary embodiments, the common voltage provided by the common voltage generating unit during the driving period has different AC voltage swings or different DC voltage levels, so that the display abnormity of the display is eliminated by dynamically adjusting the common voltage, and thereby the display quality of the display is improved.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A multi-type common voltage driving method, adapted to drive a display, the multi-type driving method comprising:

providing a common voltage to a common electrode of the display for a sequence of common voltage switching time units to define a reference voltage of the display, wherein each of the common voltage switching time units has a plurality of different types of common voltage pattern periods, and a time length of each of the common voltage pattern periods comprises at least one frame, wherein the display displays at least one image during the at least one frame, wherein in each of the common voltage pattern periods, the common voltage comprises either alternating current (AC) voltage swings or direct current (DC) voltage level, wherein the common voltage is switched from one of the AC voltage swings and the DC voltage level to another one of the AC voltage swings and the DC voltage level, wherein during the different types of the common voltage pattern periods, the provided common voltage has different AC voltage swings or different DC voltage levels, and wherein in each of the common voltage switching time units, the different types of the common voltage pattern periods comprise:

a plurality of DC-type common voltage pattern periods, during which the provided common voltage has different DC voltage levels.

2. The multi-type common voltage driving method as claimed in claim 1, wherein in each of the common voltage switching time units, the different types of the common voltage pattern periods comprise:

a plurality of AC-type common voltage pattern periods sequentially arranged behind the DC-type common voltage pattern periods, during which the provided common voltage has different AC voltage swings.

3. The multi-type common voltage driving method as claimed in claim 1, wherein a number of the common voltage pattern periods, the respective time lengths thereof, and the respective AC voltage swings or the DC voltage levels of the common voltage therein are determined according to different types of polarity distribution patterns on the display.

4. The multi-type common voltage driving method as claimed in claim 3, wherein the display takes each of the common voltage switching time units as the repeating time unit to change its polarity distribution patterns, and the common voltage pattern periods respectively correspond to the polarity distribution patterns.

5. The multi-type common voltage driving method as claimed in claim 1, wherein the number of the common voltage pattern periods, the respective time lengths thereof, and the respective AC voltage swings or the DC voltage levels of the common voltage therein are determined according to different image contents of the display.

6. A display driving circuit, adapted to drive a display, the display driving circuit comprising:

a timing circuit, indicating a plurality of common voltage switching time units; and a common voltage generating unit, providing a common voltage having an alternating current (AC) swings or a direct current (DC) voltage level to a common electrode of the display and to define a reference voltage of the display for a sequence of the common voltage switching time units, and switching the common voltage having one of the AC voltage swings and the DC voltage level to the common voltage having another one of the AC voltage swings and the DC level voltage level, wherein each of the common voltage switching time units has a plurality of different types of common voltage pattern periods, and a time length of each of the common voltage pattern periods comprises at least one frame, wherein the display displays at least one image during the at least one frame, wherein in each of the common voltage pattern periods, the common voltage comprises either alternating current (AC) voltage swings or direct current (DC) voltage level, wherein during the different types of the common voltage pattern periods, the provided common voltage has different AC voltage swings and different DC voltage levels.

7. The display driving circuit as claimed in claim 6, further comprising:

a common voltage control unit, controlling the common voltage generating unit to provide the common voltage having different AC voltage swings or different DC voltage levels according to different types of polarity distribution patterns or different image contents of the display.

8. The display driving circuit as claimed in claim 6, wherein in each of the common voltage switching time units, the different types of the common voltage pattern periods comprise:

a plurality of AC-type common voltage pattern periods, during which the provided common voltage has different AC voltage swings.

9. The display driving circuit as claimed in claim 6, wherein in each of the common voltage switching time units, the different types of the common voltage pattern periods further comprise:

a plurality of DC-type common voltage pattern periods sequentially arranged behind the AC-type common voltage pattern periods, during which the provided common voltage has different DC voltage levels.

10. The display driving circuit as claimed in claim 6, wherein in each of the common voltage switching time units, the different types of the common voltage pattern periods comprise:

a plurality of DC-type common voltage pattern periods, during which the provided common voltage has different DC voltage levels.

11. The display driving circuit as claimed in claim 10, wherein in each of the common voltage switching time units, the different types of the common voltage pattern periods comprise:

a plurality of AC-type common voltage pattern periods sequentially arranged behind the DC-type common voltage pattern periods, during which the provided common voltage has different AC voltage swings.

12. The display driving circuit as claimed in claim 6, wherein a number of the common voltage pattern periods, the respective time lengths thereof, and the respective AC voltage swings or the DC voltage levels of the common voltage therein are determined according to different types of polarity distribution patterns on the display.

13. The display driving circuit as claimed in claim 12, wherein the display takes each of the common voltage switching time units as the repeating time unit to change its polarity distribution patterns, and the common voltage pattern periods respectively correspond to the polarity distribution patterns.

14. The display driving circuit as claimed in claim 6, wherein a number of the common voltage pattern periods, the respective time lengths thereof, and the respective AC voltage swings or the DC voltage levels of the common voltage therein are determined according to different image contents of the display.

15. A common voltage control apparatus, adapted to a display driving circuit, wherein the display driving circuit comprises a common voltage generating unit, the common voltage control apparatus controls the common voltage generating unit according to different types of polarity distribution patterns or different image contents of the display, a common voltage for a sequence of common voltage switching time units, wherein the repeating time unit is repeated in a driving period, wherein each of the common voltage switching time units has a plurality of different types of common voltage pattern periods, and a time length of each of the common voltage pattern periods comprises at least one frame, wherein in each of the common voltage pattern periods, the common voltage comprises either alternating current (AC) voltage swings or direct current (DC) voltage level, wherein the common voltage is switched from one of the AC voltage swings and DC voltage level to another one of the AC voltage swings and the DC voltage level, wherein during the different types of the common voltage pattern periods, the provided common voltage has different AC voltage swings and different DC voltage levels, wherein the provided common voltage is applied on a common electrode of the display.

16. The common voltage control apparatus as claimed in claim 15, comprising:

an image determining unit, determining a type of the polarity distribution pattern or the image contents according to an image displayed on the display to provide a determination result; and a logic control unit, controlling the common voltage generating unit to provide the common voltage having different AC voltage swings or different DC voltage levels according to the determination result.

17. The common voltage control apparatus as claimed in claim 16, further comprising:

a look-up table, storing corresponding relationship between the types of the polarity distribution patterns or the image contents and the AC voltage swings or DC voltage levels of the common voltage, wherein the logic control unit controls the common voltage generating unit to provide the common voltage having different AC voltage swings or different DC voltage levels according to the look-up table.

18. A multi-type common voltage driving method, adapted to drive a display, the multi-type common voltage driving method comprising:

providing a common voltage having one of an alternating current (AC) pattern or a direct current (DC) pattern to a common electrode to define a reference voltage of the display as to drive the display;

taking a common voltage switching time unit as a repeating time unit to determine a polarity distribution pattern or an image content of a current image displayed on the display, wherein the repeating time unit is repeated in a driving period;

according to the polarity distribution pattern or the image content of the current image, switching the common voltage from the provided AC pattern or the DC pattern to another one of the AC pattern and the DC pattern and adjusting AC voltage swings of the AC pattern or a DC voltage level of the DC pattern of the common voltage, wherein a time length of each of the common voltage pattern periods comprises at least one frame, and the display displays at least one image during the at least one frame, and wherein in each of the common voltage switching time units, the different types of the common voltage pattern periods comprise:

a plurality of DC-type common voltage pattern periods, during which the provided common voltage has different DC voltage levels.

19. The multi-type common voltage driving method as claimed in claim 18, wherein during the different types of the common voltage pattern periods, the provided common voltage has different AC voltage swings.

20. A multi-type common voltage driving method, adapted to drive a display, the multi-type driving method comprising:

taking a common voltage switching time unit as a repeating time unit to provide a common voltage to apply the common voltage on a common electrode of the display and to define a reference voltage of the display, wherein the common voltage switching time unit has a plurality of different types of common voltage pattern periods, and a time length of each of the common voltage pattern periods comprises at least one frame, and the display displays at least one image during the at least one frame, wherein in each of the common voltage pattern periods, the common voltage comprises either alternating current (AC) voltage swings or direct current (DC) voltage level, wherein the common voltage is switched from one of the AC voltage swings and the DC voltage level to another one of the AC voltage swings and the DC voltage level, wherein during the different types of the common voltage pattern periods, the provided common voltage has different AC voltage swings and different DC voltage levels.

21. A display driving circuit, adapted to drive a display, the display driving circuit comprising:

a timing circuit, indicating a common voltage switching time unit; and a common voltage generating unit, taking the common voltage switching time unit as a repeating time unit to provide a common voltage to a common electrode of the display as to define a reference voltage of the display, wherein the common voltage switching time unit has a plurality of different types of common voltage pattern periods, and a time length of each of the common voltage pattern periods comprises at least one frame, and wherein the display displays at least one image during the at least one frame, wherein in each of the common voltage pattern periods, the common voltage comprises either alternating current (AC) voltage swings or direct current (DC) voltage level, wherein the common voltage is switched from one of the AC voltage swings and the DC voltage level to another one of the AC voltage swings and the DC voltage level, wherein during the different types of the common voltage pattern periods, the provided common voltage has different AC voltage swings and different DC voltage levels.

22. A common voltage control apparatus, adapted to a display driving circuit, wherein the display driving circuit comprises a common voltage generating unit, the common voltage control apparatus controls the common voltage generating unit to take a common voltage switching time unit as a repeating time unit to provide a common voltage to apply the common voltage on a common electrode of the display according to different types of polarity distribution patterns or different image contents of the display, wherein the common voltage switching time unit has a plurality of different types of common voltage pattern periods, and a time length of each of the common voltage pattern periods comprises at least one frame, and the display displays at least one image during the at least one frame, wherein in each of the common voltage pattern periods, the common voltage comprises either alternating current (AC) voltage swings or direct current (DC) voltage level, wherein the common voltage is switched from one of the AC voltage swings and the DC voltage level to another one of the AC voltage swings and the DC voltage level, wherein during the different types of the common voltage pattern periods, the provided common voltage has different the voltage swings and different DC voltage levels.

23. A multi-type common voltage driving method, adapted to drive a display, the multi-type common voltage driving method comprising:

providing a common voltage having one of alternating current (AC) pattern and a direct current (DC) pattern to a common electrode to define a reference voltage of the display as to drive the display;

taking a common voltage switching time unit as a repeating time unit to determine a polarity distribution pattern or an image content of a current image displayed on the display;

according to the polarity distribution pattern or the image content of the current image, switching the common voltage from the provided AC pattern or the DC pattern to another one of the AC pattern and the DC pattern and adjusting AC voltage swings of the AC pattern or a DC voltage level of the DC pattern of the common voltage, wherein the common voltage switching time unit has a plurality of different types of common voltage pattern periods, and a time length of each of the common voltage pattern periods comprises at least one frame, and the display displays at least one image during the at least one frame, and wherein during the different types of the common voltage pattern periods, the provided common voltage has different AC voltage swings and different DC voltage levels.

* * * * *